US009173490B2

(12) United States Patent
McMillin et al.

(10) Patent No.: US 9,173,490 B2
(45) **Date of Patent: *Nov. 3, 2015**

(54) ANTI-TIP AND RETENTION ASSEMBLY FOR APPLIANCE SUPPORT PLATE

(71) Applicant: SSW Holding Company, Inc., Fort Smith, AR (US)

(72) Inventors: Matthew McMillin, Palmyra, IN (US); Jason Robert Yochum, Haubstadt, IN (US)

(73) Assignee: SSW Holding Company, Inc., Fort Smith, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/594,354

(22) Filed: Jan. 12, 2015

(65) Prior Publication Data

US 2015/0124453 A1 May 7, 2015

Related U.S. Application Data

(63) Continuation of application No. 13/970,258, filed on Aug. 19, 2013, now Pat. No. 8,960,827.

(60) Provisional application No. 61/692,958, filed on Aug. 24, 2012.

(51) Int. Cl.

| | |
|---|---|
| ***A47B 96/04*** | (2006.01) |
| ***A47B 96/06*** | (2006.01) |
| ***A47B 96/02*** | (2006.01) |
| ***A47B 55/00*** | (2006.01) |
| ***F21V 33/00*** | (2006.01) |
| *F25D 25/02* | (2006.01) |

(52) U.S. Cl.
CPC ..... *A47B 96/06* (2013.01); *A47B 55/00* (2013.01); *A47B 96/027* (2013.01); *A47B 96/028* (2013.01); *F21V 33/0012* (2013.01); *F25D 25/02* (2013.01)

(58) Field of Classification Search
CPC ..... A47F 5/103; A47B 57/42; A47B 57/425; A47B 96/028; A47B 96/027; F25D 25/02
USPC ..... 312/408; 108/106–110
See application file for complete search history.

(56) References Cited

U.S. PATENT DOCUMENTS

| | | | | |
|---|---|---|---|---|
| 5,287,252 | A * | 2/1994 | Caruso | 362/92 |
| 6,231,205 | B1 * | 5/2001 | Slesinger et al. | 362/133 |
| 7,338,180 | B2 * | 3/2008 | Wing | 362/92 |
| 8,322,873 | B2 * | 12/2012 | Glovatsky et al. | 362/92 |
| 8,646,935 | B2 * | 2/2014 | Karan | 362/125 |
| 2003/0222043 | A1 * | 12/2003 | Rouch et al. | 211/153 |

(Continued)

*Primary Examiner* — Hanh V Tran
(74) *Attorney, Agent, or Firm* — Marshall, Gerstein & Borun LLP

(57) ABSTRACT

A shelving assembly includes a support plate, left and right side supports, and rear and front anti-tip and retention features. The side supports each include a front end located adjacent to a front edge of the support plate, and a rear end located adjacent to a rear edge of the support plate. A portion of the rear and front anti-tip and retention features is disposed above the support plate for preventing tipping and for retaining the support plate on the side supports. The front and rear anti-tip and retention features are spaced apart such that a majority of the top surface of the support plate along opposite left and right side edges is freely exposed and unencumbered by the front and rear anti-tip and retention features.

35 Claims, 13 Drawing Sheets

(56) References Cited

U.S. PATENT DOCUMENTS

| | | | | |
|---|---|---|---|---|
| 2005/0162055 | A1* | 7/2005 | Bienick et al. | 312/408 |
| 2009/0084914 | A1* | 4/2009 | Picken et al. | 248/206.5 |
| 2009/0115302 | A1* | 5/2009 | Benz et al. | 312/408 |
| 2009/0212505 | A1* | 8/2009 | McMillin et al. | 277/650 |
| 2010/0001625 | A1* | 1/2010 | Eckartsberg et al. | 312/408 |
| 2010/0102693 | A1* | 4/2010 | Driver et al. | 312/408 |
| 2011/0148268 | A1* | 6/2011 | Driver et al. | 312/408 |

* cited by examiner

ANTI-TIP AND RETENTION ASSEMBLY FOR APPLIANCE SUPPORT PLATE

CROSS-REFERENCE TO RELATED APPLICATIONS

This is a continuation of and claims the benefit of priority of U.S. patent application Ser. No. 13/970,258, filed Aug. 19, 2013, which itself claims the priority benefit of U.S. Provisional Patent Application No. 61/692,958, filed Aug. 24, 2012. The entire contents of each of the foregoing is hereby incorporated herein by reference.

FIELD OF DISCLOSURE

The present disclosure is directed to appliance support plates and, more particularly, to assemblies for supporting appliance support plates in appliance cavities.

BACKGROUND

Appliances contain shelves and similar storage devices within the appliance interior used to organize and support stored goods such as food and containers. These shelves and similar storage devices can be made from a variety of materials including glass, plastic, wood and metals, such as wire and sheet steel.

Conventional appliances are known to include different types of shelving designs. Some conventional shelving designs include assemblies comprising the use of different materials such as glass, plastic and metals. The kinds of materials used in shelf assemblies are chosen for a variety of reasons including cost, strength, quality, features offered, performance characteristics and design flexibility.

Many conventional shelving assemblies are often bulky and frequently utilize a combination of several of the materials identified above. In addition, conventional shelving assemblies can include adhesives, rivets or silicones to help with manufacture and assembly. One common type of conventional shelving assembly design is often referred to as encapsulated glass shelving. In this type of shelving assembly, the perimeter of a piece of glass is encapsulated in plastic such that the plastic covers the sides and adjacent edge portions of the top and bottom of the glass. Such arrangements typically rest on two metal support brackets. Such designs may also be commonly referred to as encapsulated glass cantilever shelving.

GENERAL DESCRIPTION

The present disclosure offers improvements over traditional encapsulated glass cantilever shelving. In utilizing a design that eliminates the encapsulating material on the top plane of the glass, an anti-tip and retention feature for the glass support plate is implemented to prevent the glass from tipping to the front or rear, along a transverse axis of the glass, when stored items are placed onto the support plate. By using an anti-tip and retention feature, the disclosed shelving assembly does not require encapsulating the glass support plate in plastic, thereby creating more usable shelf space within the appliance. Obtaining more usable shelf space can be a desirable feature to consumers and original equipment manufacturers. Additionally, through the use of unique side supports, the present disclosure offers a shelf product that can be easily assembled and held together without the use of adhesives or other costly secondary operations and manufacturing equipment.

Low cost tooling, ease of assembly, total shelf assembly cost, the ability to eliminate the use of adhesive, if desired, and added usable shelf space are only several of the improvements realized through the use of the subject matter disclosed herein.

As described in more detail below and in specific reference to FIGS. 1-8, the disclosed shelving assembly includes unique side supports with several features. These side support features include front and rear anti-tip and retention features for the glass support plate. In one version, the front anti-tip and retention feature can include a locking receptacle feature for secure snap fit of a front trim form (e.g., a front trim piece).

For additional support of the shelving assembly, the disclosure describes a square wire frame connected to the side supports. Alternatively, a round wire frame and/or reinforcement rods may be utilized.

It is important to note that the anti-tip and retention features expressly described herein, and as shown in the Figs, may be modified and shaped differently without departing from the spirit and scope of the disclosure.

In addition to the foregoing, the present disclosure includes LED lighting features that may also be incorporated into the shelf assembly design. In particular, and as will be described below, the shelf assembly may utilize the following:

- a contact housing containing a contact strip
- a LED light strip
- wiring or ribbon cable for getting power to the LED light strip (not shown in the figures)
- The shelf supports may alternately utilize a central valley (not shown in the figures) in the horizontal cross section to help provide a resting place for the wiring or ribbon cable As will be appreciated, the LED features are completely optional.

In addition, the shelving assembly described herein may utilize hydrophobic shelf treatments (not shown) that provide the ability to contain spills on the top surface of the support plate of the shelf.

Some versions of the shelving assembly can utilize sheet steel as the side support material, while in others, the side supports may be made of other materials such as plastic without departing from the scope of the disclosure. Also, alternate materials other than glass may be utilized for the support plate.

Finally, the disclosure may also include a rear plastic trim piece with corresponding locking receptacle features located at the rear of the shelf assembly (this version is not shown in the figures but similar to the locking receptacle feature and trim piece at the front of the shelf assembly as shown in FIGS. 1-8).

DETAILED DESCRIPTION

As mentioned, one version of the present disclosure is directed to a shelving assembly for an appliance, for example, and includes an anti-tip and retention assembly that is arranged and configured such as to maximize the amount of exposed and unencumbered shelf space on the shelving assembly. In the present disclosure, the shelving assembly includes a support plate, left and right side supports, and the anti-tip and retention assembly can include rear and front anti-tip and retention features. The support plate can have opposite top and bottom surfaces, opposite left and right side edges, and opposite front and rear edges extending laterally between the left and right side edges. The left and right side supports can be arranged to support the bottom surface of the support plate at the left and right side edges, respectively. So arranged, the side supports are for supporting the support plate in a cavity of the appliance. Each of the left and right side supports include a front end adapted to be located adjacent to the front edge of the support plate, and a rear end adapted to be located adjacent to the rear edge of the support plate. The rear anti-tip and retention feature is connected to the rear end of at least one of the left and right side supports such that at least a portion of the rear anti-tip and retention feature is disposed above the top surface of the support plate adjacent to the rear edge for preventing tipping of the support plate and for retaining the support plate on the left and right side supports. The front anti-tip and retention feature is connected to the front end of at least one of the left and right side supports such that at least a portion of the front anti-tip and retention feature is disposed above and adjacent to the top surface of the support plate adjacent to the front edge for preventing tipping of the support plate and for retaining the support plate on the left and right side supports. Finally, in this configuration, the front and rear anti-tip and retention features are spaced apart such that a majority of the top surface of the support plate along the left and right side edges is freely exposed and unencumbered by the front and rear anti-tip and retention features or otherwise. Examples of these various details and features will now be described with reference to the Figs.

Figure 1:
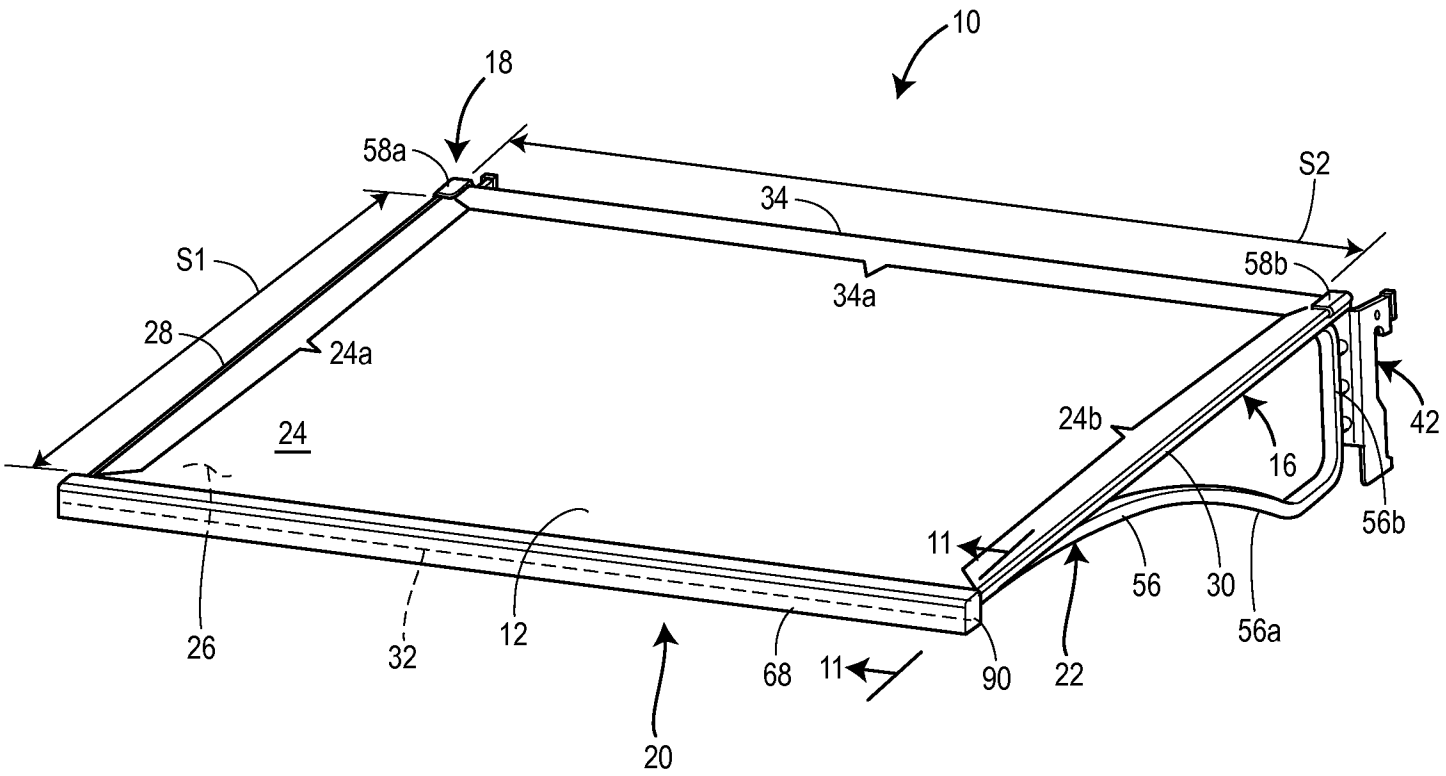
FIG. 1 is a front perspective view of one version of a shelving assembly constructed in accordance with the principles of the present disclosure.
Figure 2:
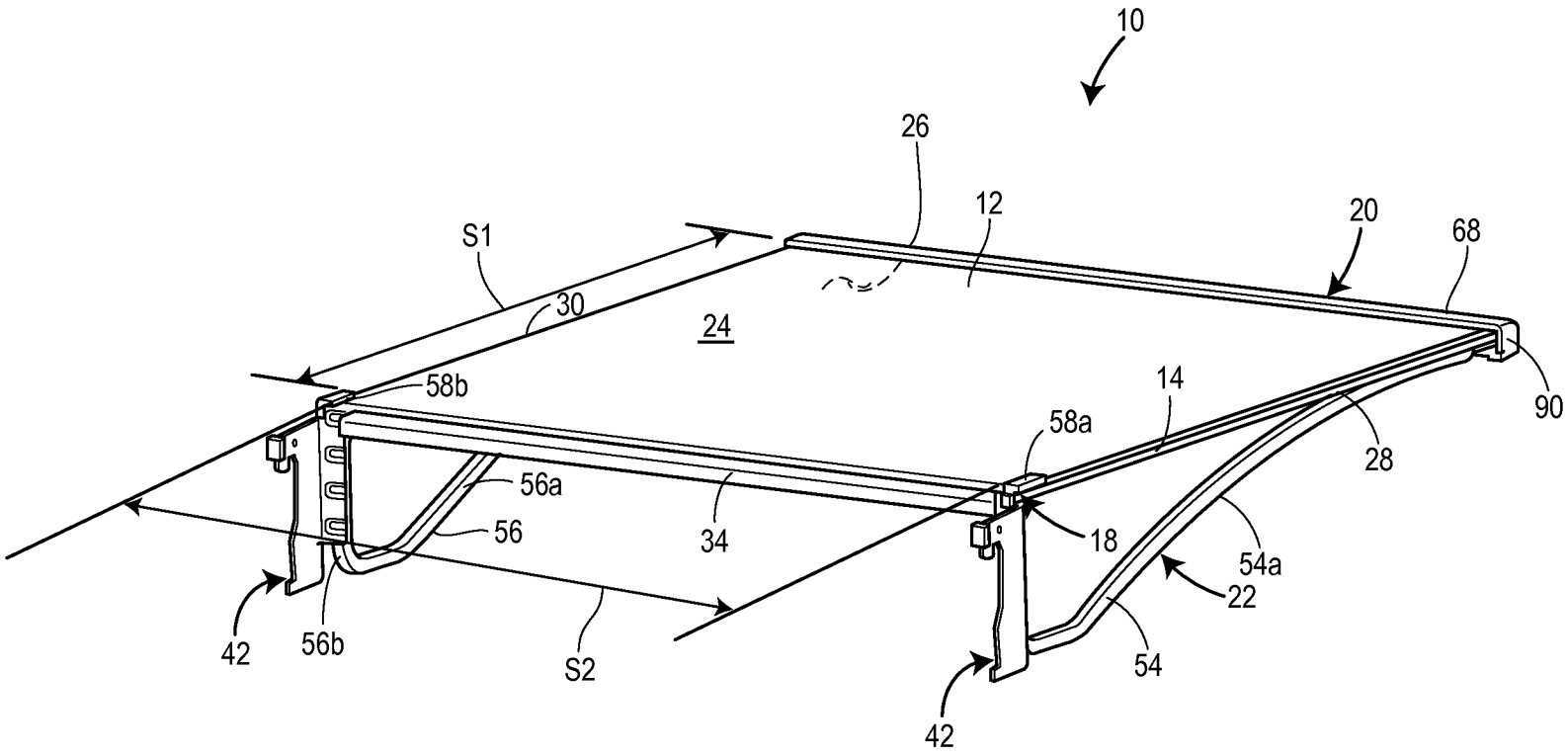
FIG. 2 is a rear perspective view of the shelving assembly of claim 1.
Figure 3:
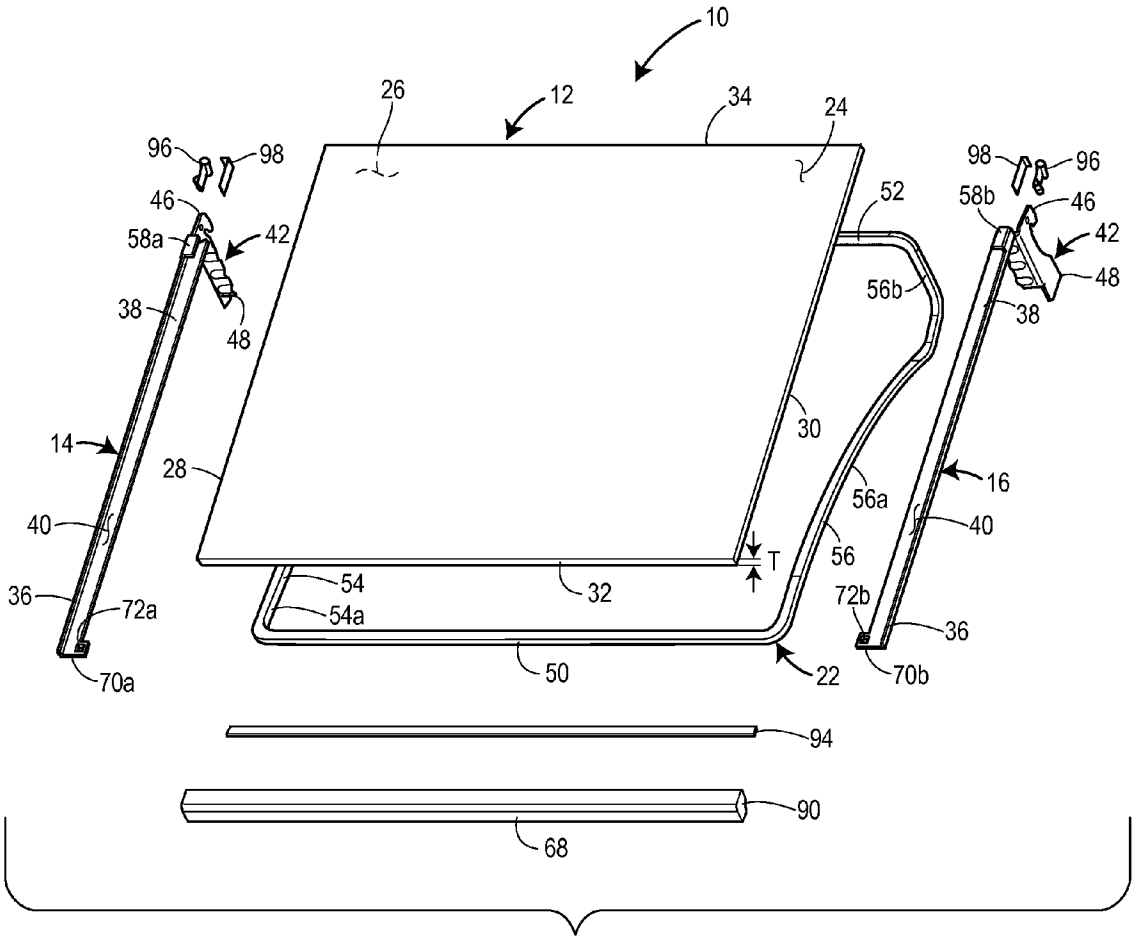
FIG. 3 is an exploded perspective view of the shelving assembly of FIGS. 1 and 2.

Referring to FIGS. 1-3, various views of one version of a shelving assembly 10 constructed in accordance with the principles of the present disclosure are depicted. The shelving assembly 10 includes a support plate 12, left and right side supports 14, 16, a rear anti-tip and retention feature 18, a front anti-tip and retention feature 20, and a frame 22. The support plate 12 can include a glass plate (or some other material) having opposite top and bottom surfaces 24, 26, opposite left and right side edges 28, 30, and opposite front and rear edges 32, 34. The glass support plate 12 can include a conventional glass support plate with or without a treatment coating, for example. In one optional version, the support plate can include a shelf plate having a top surface including a hydrophobic surface arranged on the top surface in a spill containment pattern, for example, as disclosed in U.S. Patent Publication No. 2010/0102693, the entire contents of which are hereby incorporated herein by reference.

Figure 5:
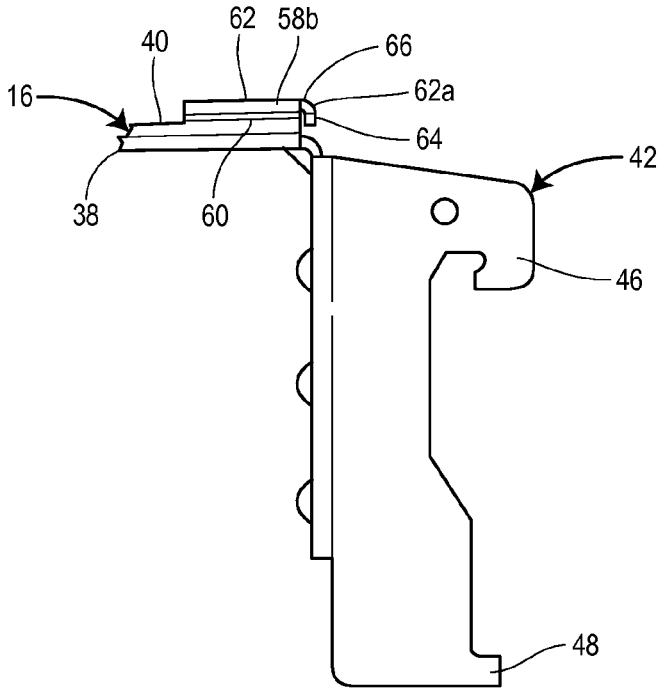
FIG. 5 is a side view of a rear end portion of the side support of FIG. 4.
Figure 6:
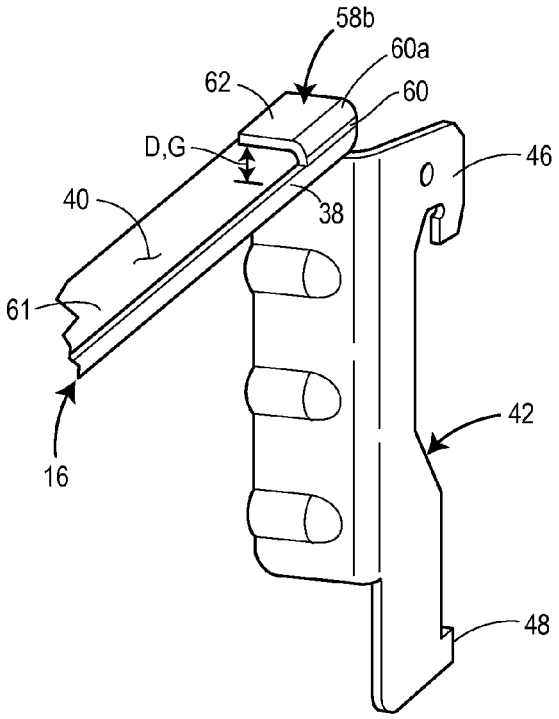
FIG. 6 is a front perspective view of a rear end portion of the side support of FIG. 4.
Figure 9:
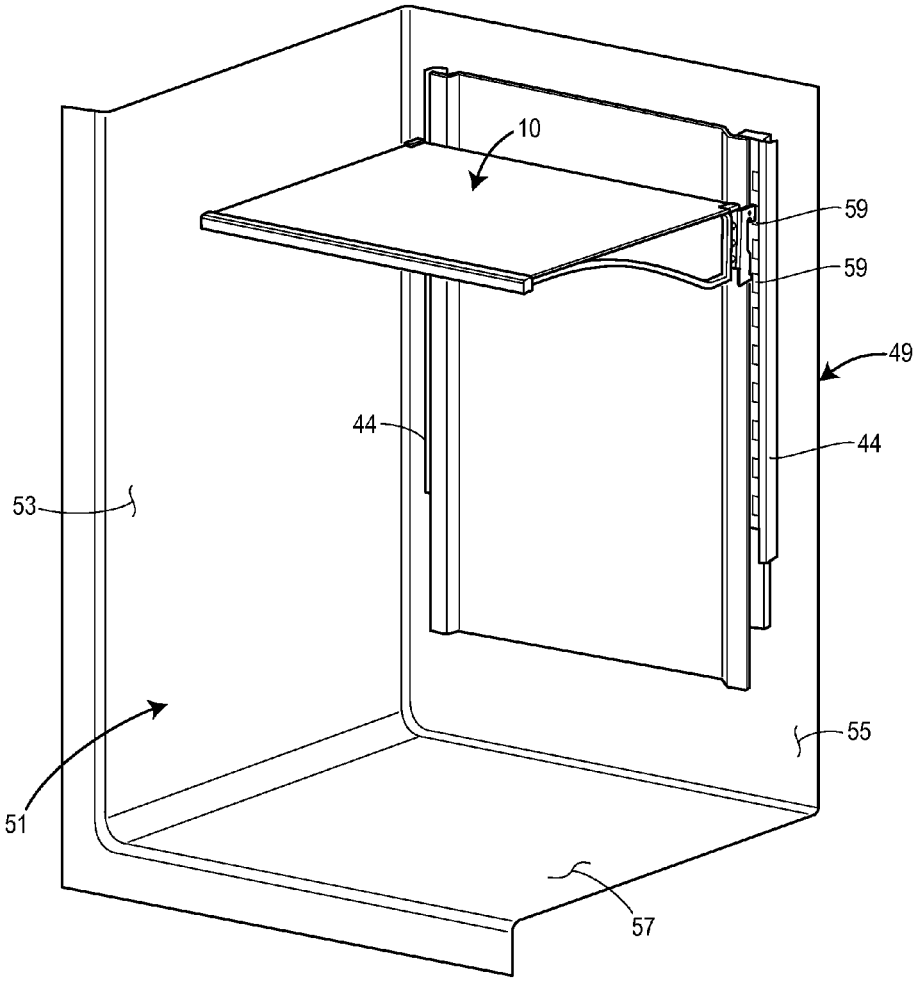
FIG. 9 is a perspective view of the shelving assembly of FIGS. 1 to 8 disposed within an appliance.
Figure 10:
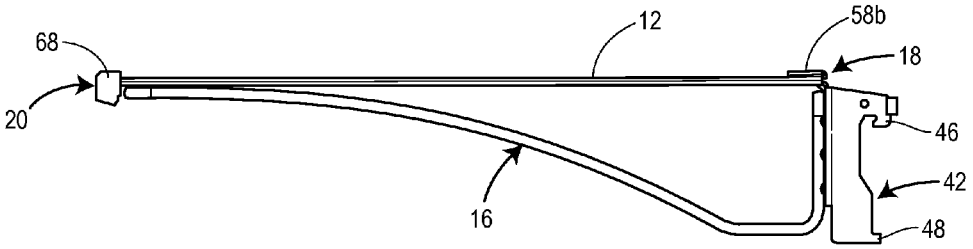
FIG. 10 is a right side view of the shelving assembly of FIG. 1.

As shown, the front and rear edges 32, 34 extend perpendicular to and between the opposite left and right side edges 28, 30 to define the support plate 12 as having a generally rectangular shape. Other shapes of the support plate 12, however, are intended to be within the scope of the present disclosure. The left and right side supports 14, 16 are arranged adjacent to, and in one version in contact with, the bottom surface 26 of the support plate 12 at the left and right side edges 28, 30, respectively. So arranged, the side supports 14, 16 are for supporting the support plate 12 in a cavity of an appliance, for example, as will be described. As indicated in FIG. 3, each of the left and right side supports 14, 16 includes a generally elongated flat form having a front end 36 located adjacent to the front edge 32 of the support plate 12, and a rear end 38 located adjacent to the rear end 34 of the support plate 12. At the rear ends 38, each side support 14, 16 of the version disclosed in FIGS. 1-3 includes a support bracket 42 for engaging support forms that can include conventional vertical support members 44 of an appliance 49, as shown in FIG. 9, for example. The appliance 49 can include a refrigerator, a freezer, or any other appliance or structure defining a storage compartment, for example. In FIG. 9, it can be seen that the conventional appliance 49 defines a cavity 51 for receiving the shelving assembly 10, and which is defined by opposite side walls 53 (only one of which is shown), a rear wall 55, a bottom wall 57, and a top wall (not shown). The vertical support members 44 are mounted to the rear wall 55 in a conventional manner. The support brackets 42 themselves can also be conventional in that they include a hanger portion 46 and a stabilizing tab 48, as best shown in FIGS. 4-6, for engaging a pair of vertically spaced apertures 59 (shown in FIG. 9) in the conventional vertical support members 44.

The side supports 14, 16 can be constructed of sheet metal, plastic, or any other suitable material. In some versions, a top surface 40 of the side supports 14, 16 can simply engage and contact the bottom surface 26 of the support plate 12 adjacent to the left and right side edges 28, 30, respectively, in order to support the support plate 12. In other versions, the top surfaces 40 of the side supports 14, 16 can be adhered to the bottom surface 26 of the support plate 12 such that an adhesive is disposed between at least a portion of the top surface 40 of the side supports 14, 16 and the bottom surface 26 of the support plate 12.

Figure 4:
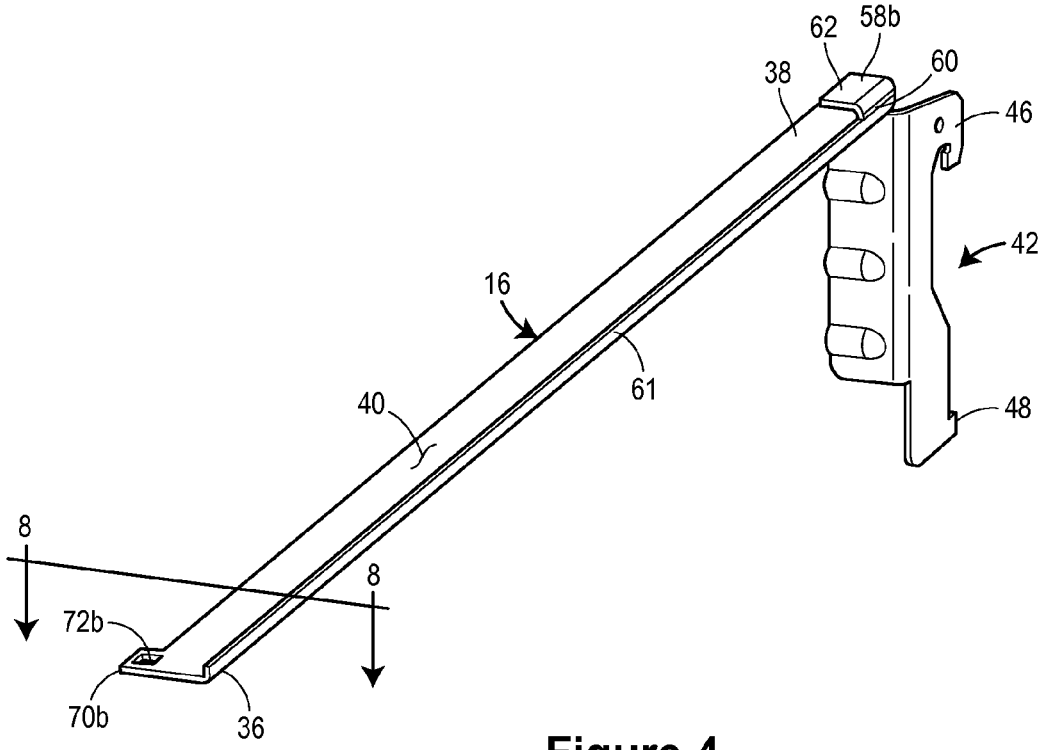
FIG. 4 is a perspective view of a right side support of the shelving assembly of FIGS. 1 to 3.

In FIGS. 3 and 4, one version of the support brackets 42 is illustrated wherein the side supports 14, 16, and therefore, the top surfaces 40 of the side supports 14, 16, are positioned entirely in-board of the corresponding hanger portions 46 and stabilizing tabs 48. So configured, the support plate 12 in this version would also be disposed entirely in-board of and between the hanger portions 46 and stabilizing tabs 48 of the side supports 14, 16. In other versions, however, the side supports 14, 16 can be positioned partially in-board and thus, also partially out-board, or even entirely out-board of the corresponding hanger portions 46 and stabilizing tabs 48. In such versions, the left and right side edges 28, 30 of the support plate 12 would then also extend partially outboard of the hanger portions 46 and stabilizing tabs 48 of the side supports 14, 16, respectively. The specific design and configuration in some versions might be dependent, for example, on the spacing between the spaced apertures 59 (shown in FIG. 9) in the vertical support members 44 or for some other reason.

As mentioned, the shelving assembly 10 of the present version further includes the frame 22, as shown in FIGS. 1-3. The frame 22 of this version can be constructed from a metal wire having a generally rectangular cross-section (e.g., a square cross-section) and is fixed to and beneath the side supports 14, 16 for providing added strength and integrity to the shelving assembly 10 by assisting with the cantilevered supporting function of the side supports 14, 16. As shown in exploded perspective view of FIG. 3, for example, the frame 22 includes a front frame member 50, a rear frame member 52, and opposite left and right side frame members 54, 56, each of which are best shown in FIG. 3.

The front and rear frame members 50, 52 include generally straight forms extending between the front and rear ends 36, 38, respectively, of the left and right side supports 14, 16. The opposite left and right frame members 54, 56 include contoured form portions 54*a*, 56*a* and vertical form portions 54*b*, 56*b*. The vertical form portions 54*b*, 56*b* of the present version extend vertically downward from opposite ends of the rear frame member 52, while the contoured form portions 54*a*, 56*a* extend rearward and downward from opposite ends of the front frame member 50 to connect with distal ends of the vertical form portions 54*b*, 56*b*. So configured, the left and right side frame members 54, 56 of the frame 22 define supporting arches that are fixed to the left and right side supports 14, 16, respectively. In one version, the frame 22 can be fixed to the side supports 14, 16 via welding, brazing, adhesives, fasteners, or any other suitable means. In other versions, the shelving assembly 10 can be constructed without the frame 22 or the frame 22 and the side supports 14, 16 can be integral. In versions without the frame 22, the side supports 14, 16 can provide sufficient strength to hold the support plate 12 in a cantilevered fashion or otherwise.

As also mentioned above, the shelving assembly 10 of the present disclosure includes the rear anti-tip and retention feature 18 and the front anti-tip and retention feature 20. In the version of the assembly 10 disclosed in FIGS. 1-11, the rear anti-tip and retention feature 18 includes two (2) separate left and right rear anti-tip and retention forms 58*a* and 58*b* connected to the rear ends 38 of the left and right side supports 14, 16, respectively. In the disclosed version, the rear anti-tip and retention forms 58*a*, 58*b* are formed as one-piece (e.g., integral) with the left and right side supports 14, 16, respectively. The rear anti-tip and retention forms 58*a*, 58*b* are identical mirror opposites of each other, and therefore, the details of only the right rear form 58*b* will be described.

With reference to FIGS. 4-7, the right rear anti-tip and retention form 58*b* that is connected to the right side support 16 is illustrated in detail. As shown, the rear anti-tip and retention form 58*b* includes a side plate 60, a bearing plate 62, and a stop plate 64. The side plate 60 extends upwardly from an outer edge of the top surface 40 of the side support 16. The bearing plate 62 extends perpendicular to the side plate 60 such that the bearing plate 62 is disposed above the top surface 40. In the disclosed version, the bearing plate 62 is disposed a distance D away from the top surface 40. The distance D is equal to or slightly greater than a thickness T (shown in FIG. 3) of the support plate 12 such as to define a gap G for receiving a portion of the support plate 12, as shown in FIG. 1, for example. The stop plate 64 extends downwardly adjacent a rear end 66 of the bearing plate 62 and toward the top surface 40 of the side support 16, as depicted in FIG. 5, for example. In the depicted version, and as shown in FIGS. 4-6, for example, the rear anti-tip and retention form 58*b* further includes a radiused side portion 60*a* disposed between the side plate 60 and the bearing plate 62 and a radiused rear portion 62*a* disposed between the bearing plate 62 and the stop plate 64. The radiused side and rear portions 60*a*, 62*a* can be a by-product of the fact that a version of the integral side support 16 and anti-tip and retention form 58*b* can be constructed from formed (e.g., bent, shaped, etc.) sheet metal, for example. Other versions constructed of different materials or through different manufacturing processes certainly may not include the radiused portions 60*a*, 62*a*.

As configured as described above, the side plate 60, the bearing plate 62, and the stop plate 64 of the ant-tip and retention form 58*b* defines an envelope at the gap G that is adapted to accommodate (e.g., receive) a rear corner of the support plate 12 of the shelving assembly 10, as depicted in FIGS. 1 and 2, for example. So configured, when accommodating the support plate 12, the side plate 60 of the rear anti-tip and retention form 58*b* is selectively engaged by the right side edge 30 to limit lateral displacement of the support plate 12, the stop plate 64 is selectively engaged by the rear edge 34 to limit rearward displacement of the support plate 12, and finally the bearing plate 62 is selectively engaged by the top surface 24 to limit upward displacement of the support plate 12. As mentioned above, the left rear anti-tip and retention form 58*a* is an identical mirror opposite of the right rear anti-tip and retention form 58*b* such that it too limits lateral, rearward, and upward displacement of the support plate 12. Therefore, in combination, the left and right rear anti-tip and retention forms 58*a*, 58*b* of the rear anti-tip and retention feature 18 of the present version of the disclosure suitably prevents tipping of the support plate 12 off of the rear ends 38 of the side supports 14, 16, when the top surface 24 of the support plate 12 is loaded, for example, with product adjacent to only the front edge 32, for example.

Figure 7:
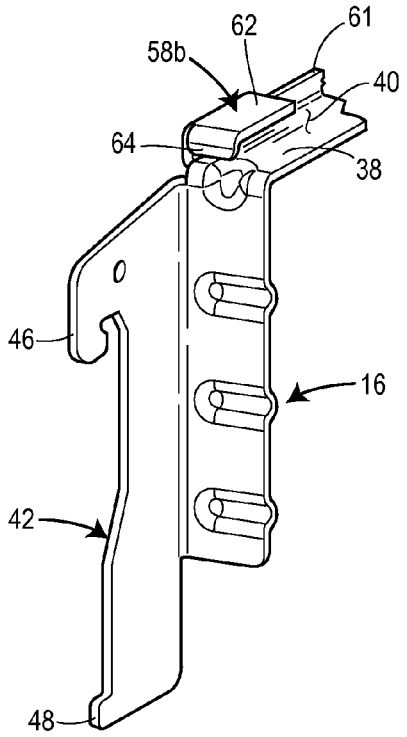
FIG. 7 is a rear perspective view of the rear end portion of the side support of FIG. 6.
Figure 8:
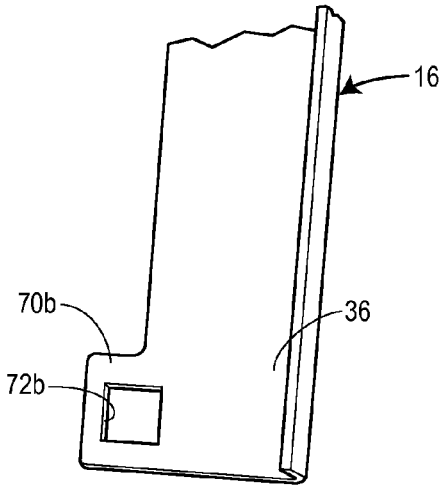
FIG. 8 is top view of a front end portion of the side support of FIG. 4, taken from the perspective of line 8-8 of FIG. 4.

As shown in FIGS. 4, 6, and 7, for example, the present version of the left and right side supports 14, 16 can also optionally include a side rail 61 extending between the front and rear ends 36, 38 upward from the outer edge of the top surface 40 of the side supports 14, 16. So arranged, the side rails 61 can be selectively engaged by the side edges 28, 30 of the support plate 12 to limit lateral displacement of the support plate 12 on the side supports 14, 16. In another version not depicted, the support surface 40 can be discontinuous such that a mid-portion of the support surface 40 is removed and a front portion of the support surface 40 adjacent to the front end 36 would be connected to a rear portion of the support surface 40 adjacent the rear end 38 by the side rail 61. The removed section of the support surface 40 could be any amount including for example 40%, 50%, 60%, 70%, etc. Such a configuration could be desirable in order to reduce the amount of material to result in potential material cost and weight reductions.

Figure 11:
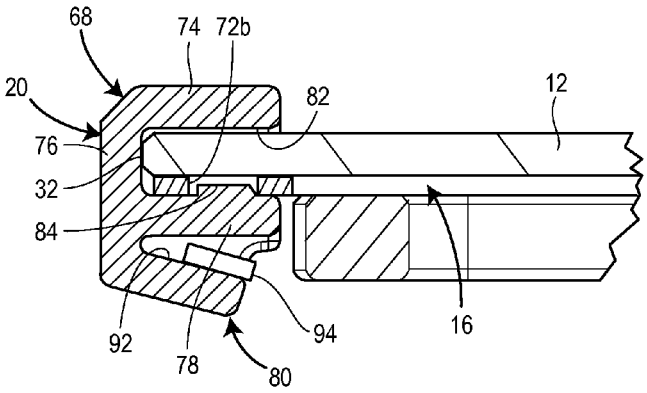
FIG. 11 is a cross-sectional view of the shelving assembly of FIG. 1 taken through line 11-11 of FIG. 1.

Referring back to FIGS. 1-4, the front anti-tip and retention feature 20 of the present version of the disclosed shelving assembly 10 will be described. In this version, and as best shown in FIGS. 1, 2, and 3, for example, the front anti-tip and retention feature 20 includes a front trim form 68 and left and right locking tabs 70*a*, 70*b* carried by the front ends 36 of the left and right side supports 14, 16, respectively. The front trim form 68 includes an elongated member extending along the front edge 32 of the support plate 12 between the front ends 36 of the left and right side supports 14, 16. FIG. 11 depicts a cross-section of the front trim form 68, which includes a bearing portion 74, a stop portion 76, a lock portion 78, and, in some versions, an optional light packaging portion 80, as will be described below. The bearing portion 74, stop portion 76, and locking portion 78 define an elongated recess (e.g., a channel) 82 extending the length of the front trim form 68 and adapted to receive a portion of the support plate 12 adjacent to the front edge 32, including the front edge 32.

Referring back to FIGS. 3 and 8, each of the locking tabs 70*a*, 70*b* of the disclosed version of the front anti-tip and retention feature 20 are part of and extend inwardly from the front ends 36 of the side supports 14, 16, toward each other and beneath the support plate 12. Moreover, the locking tabs 70*a*, 70*b* define locking apertures 72*a*, 72*b* for connecting the side supports 14, 16 to the front trim form 68. For example, as depicted in FIG. 11, each end of the front trim form 68 includes a locking button 84 extending upward from the locking portion 78 and into the elongated recess 82. When the front trim form 68 is arranged on the support plate 12, as depicted, the locking buttons 84 are disposed in the locking apertures 72*a*, 72*b* of the locking tabs 70*a*, 70*b* of the front anti-tip and retention feature 20. So disposed, the front trim form 68 becomes connected to the side supports 14, 16 such that the bearing portion 74 of the front trim form 68 is disposed above the top surface 24 of the support plate 12 adjacent to the front edge 32. As such, the bearing portion 74 is selectively engaged by the top surface 24 of the support plate to limit upward displacement of the support plate 12 and the stop portion 76 of the front trim form 68 is selectively engaged by the front edge 32 of the support plate 12 to limit forward displacement of the support plate 12. Additionally, as shown in FIGS. 1, 2, and 3, for example, each end of the front trim form 68 includes an end cap portion 90 that closes off each respective end of the elongated recess 82 (shown in FIG. 11). So configured, when the front trim form 68 is connected to the support plate 12 and to the locking tabs 70*a*, 70*b* via the locking apertures 72*a*, 72*b*, the end cap portions 90 are selectively engaged by the side edges 28, 30 of the support plate 12 to limit lateral displacement of the support plate 12.

From the foregoing, it should be appreciated that the combination of the rear and front anti-tip and retention features 18, 20 of the shelving assembly 10 disclosed with reference to FIGS. 1-11, effectively and simply serve to retain the support plate 12 connected to the side supports 14, 16, while advantageously preventing tipping when the support plate 12 is unevenly loaded, for example.

Furthermore, as shown in FIGS. 1 and 2, for example, when assembled with the support plate 12, the rear and front ant-tip and retention features 18, 20 of the presently disclosed version of the shelving assembly 10 are spaced apart by a distance S1 that is equal to a majority of the length of the left and right side edges 28, 30 of the support plate 12. As such, a majority of the top surface 24 of the support plate 12 adjacent to the left and right side edges 28, 30 is freely exposed and unencumbered by the rear and front anti-tip and retention features 18, 20. Said another way, the top surface 24 of the support plate 12 includes freely exposed and unencumbered side portions 24*a*, 24*b* (shown in FIG. 1, for example) that extend between the rear and front anti-tip and retention features 18, 20 along the majority of the side edges 28, 30 of the support plate 12. Therefore, the left, right, front, and rear edges 28, 30, 32, 34 of the support plate 12 define a perimeter of the support plate 12 that is not completely encapsulated by a plastic encapsulating component, for example, as is common in conventional shelving assemblies.

Similarly, in the version of the shelving assembly 10 disclosed in FIGS. 1-11, the rear anti-tip and retention forms 58*a*, 58*b* of the rear anti-tip and retention feature 18 are spaced apart by a distance S2 that is equal to a majority of the length of the rear edge 34 of the support plate 12. As such, a majority of the top surface 24 of the support plate 12 adjacent to the rear edge 34 is freely exposed and unencumbered by the rear anti-tip and retention feature 18. Said another way, the top surface 24 of the support plate 12 includes freely exposed and unencumbered rear portion 34*a* (shown in FIG. 1, for example) that extends between the left and right anti-tip and retention forms 58*a*, 58*b* of the rear anti-tip and retention feature 18 along the majority of the rear edge 34 of the support plate 12. So configured, the version of the shelving assembly 10 disclosed in FIGS. 1-11 maximizes the useful space on the top surface 24 of the support plate 12, both adjacent to the side edges 28, 30 and adjacent to the rear edge 34, while also providing sufficient strength and integrity for performing the supporting function.

Referring back to FIG. 11, and as mentioned above, one version of the front trim form 68 of the presently disclosed front anti-tip and retention feature 20 can optionally include the light packaging portion 80. As shown in FIG. 11, the light packaging portion 80 can include an elongated recess 92 formed in the front trim form 68 and receiving a light strip 94 such as an LED light strip for providing a lighting feature beneath the support plate 12. To accommodate this lighting feature, the present shelving assembly 10 can also include a contact housing 96 containing a contact strip 98 on one or more of the rear ends 38 of the side supports 14, 16, two of which are shown in FIG. 3, for example. Although not shown in the Figs., wiring or ribbon cable for transmitting power to the light strip 94 can also be provided. In one version, the top surfaces 40 of the side supports 14, 16 could include a central valley (not shown in the figures) to provide a resting place for the wiring or ribbon cable for extending between the light strip 94 and contact housing 96 and contact strip 98. To reiterate, the light packaging portion 80, light strip 94, and related components described above and depicted in the figures are completely optional.

While the shelving assembly of FIGS. 1-11 has been described above as including a rear anti-tip and retention feature 18 that includes two separate left and right anti-tip and retention forms 58*a*, 58*b* connected to the rear ends 38 of the left and right side supports 14, 16, an alternative version of the shelving assembly can include a rear anti-tip and retention feature 18 that is more similar to the front anti-tip and retention feature 20 disclosed in FIGS. 1-11. That is, instead of having the left and right anti-tip and retention forms 58*a*, 58*b*, the rear anti-tip and retention feature 18 could include a rear trim form and a pair of locking tabs with associated locking apertures connected to the rear ends of the opposite left and right side supports 14, 16, in a manner identical to or similar to the tabs 70*a*, 70*b* described with reference to the front anti-tip and retention feature 20.

Figure 12:
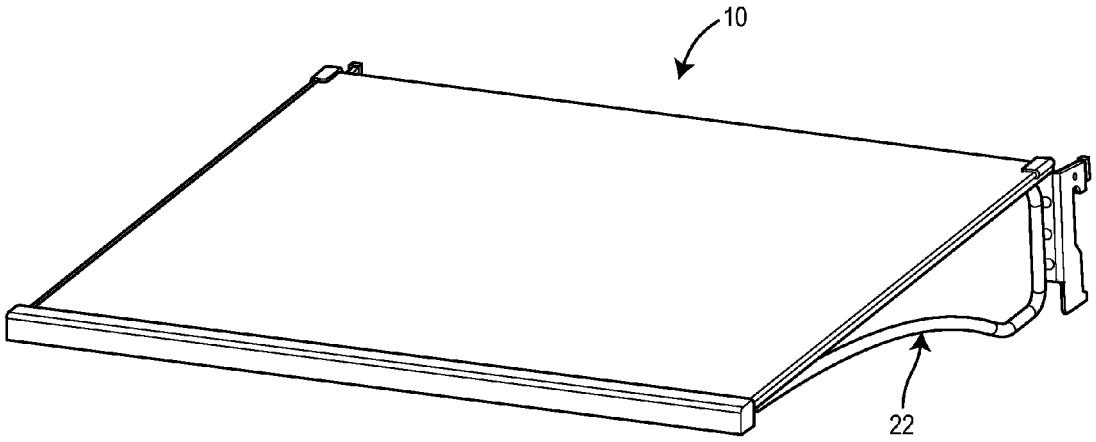
FIG. 12 is a front perspective view of an alternative version of the shelving assembly of FIG. 1.
Figure 13:
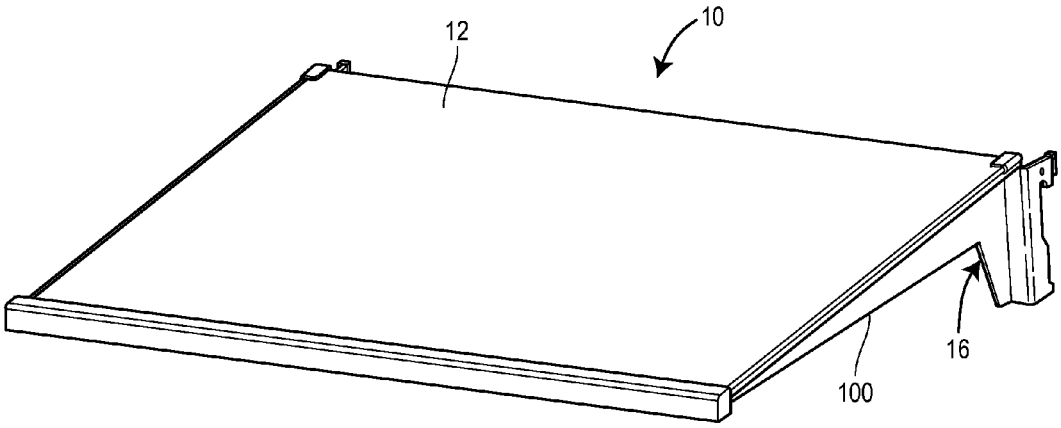
FIG. 13 is a front perspective view of another alternative version of the shelving assembly of FIG. 1.
Figure 14:
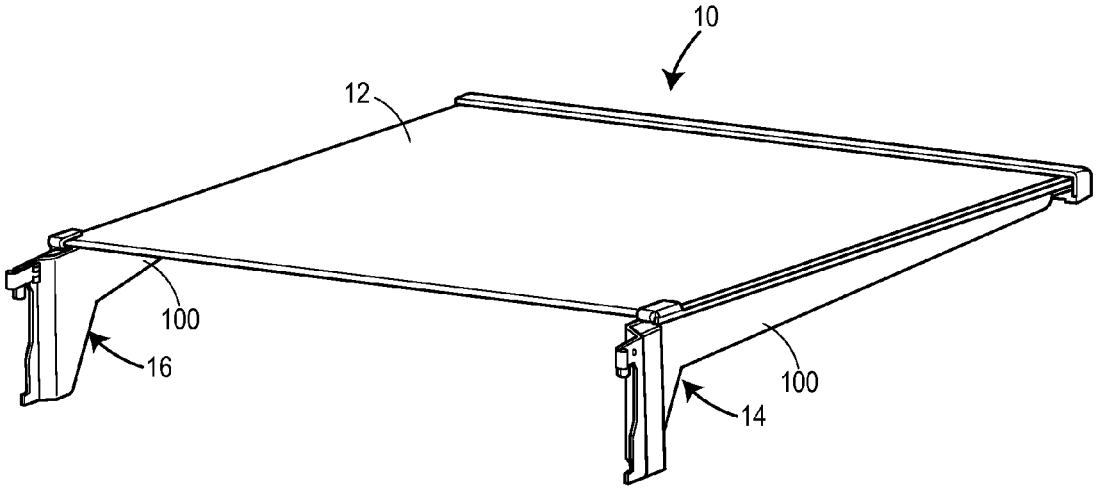
FIG. 14 is a rear perspective view of the version of the shelving assembly of FIG. 13.
Figure 15:
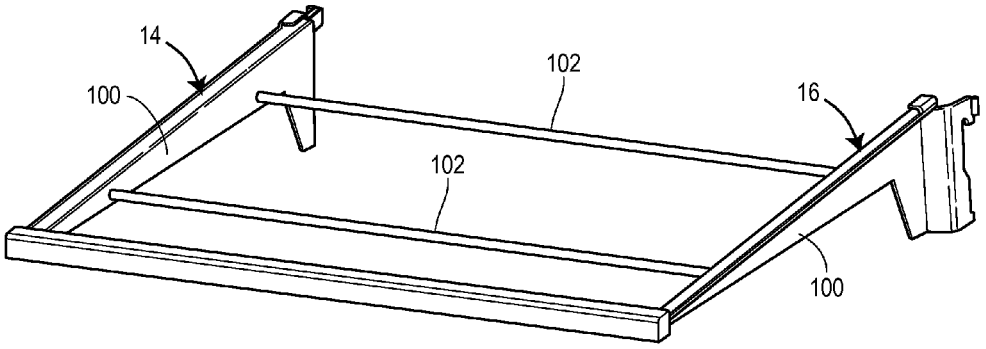
FIG. 15 is a front perspective view of an optional version of the shelving assembly of FIGS. 13-14 with a support plate thereof removed.
Figure 16:
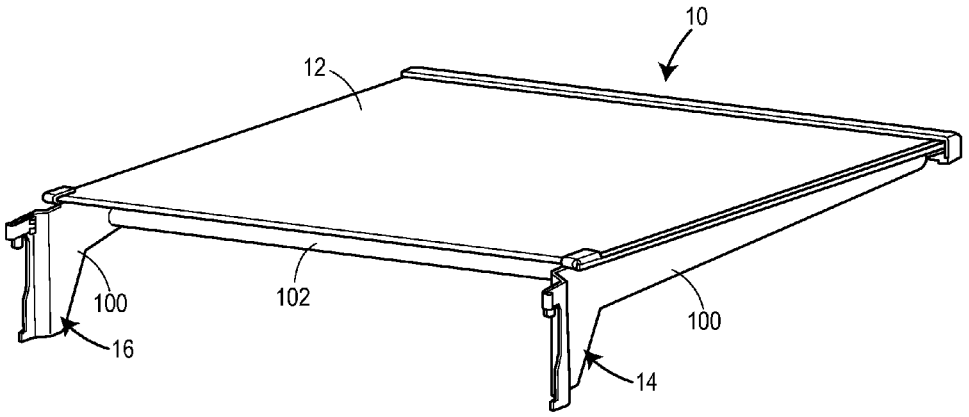
FIG. 16 is a rear perspective view of the version of the shelving assembly of FIG. 15 with the support plate present.

While the shelving assembly 10 has thus far been described as including side supports 14, 16 and the frame 22 constructed of a wire with a rectangular cross-section, other versions of the shelving assembly 10 can have frames 22 formed of different materials and/or with different geometries including, for example, a frame 22 that is constructed of a wire with a circular cross-section, as depicted in FIG. 12. In other versions, the wire could be flat or have some other cross-section, for example. A further alternative can be a construct that does not include a frame 22 that is separate from the side supports 14, 16, but rather, as depicted in FIGS. 13-14, the side supports 14, 16 can be constructed of sheet metal and further include downwardly extending support panels 100, thereby alleviating the need for the separate frame 22. While in some forms, these side supports 14, 16 themselves may sufficiently support the support plate 12, in one version, which is illustrated in FIG. 15, the shelving assembly 10 can further optionally include two or more reinforcement rods 102 extending between the side supports 14, 16 beneath the support plate 12. Each of the reinforcement rods 102 can be welded to inside surfaces of the side supports 14, 16, or connected with fasteners or some other suitable means. Besides the features described above, it should be appreciated that the versions of the shelving assembly 10 described with reference to FIGS. 12-16 are essentially identical in construction to the version described above with reference to FIGS. 1-11. Therefore, each additional detail will not be repeated, but it should be appreciated that they are included within these alternative versions.

Figure 17:
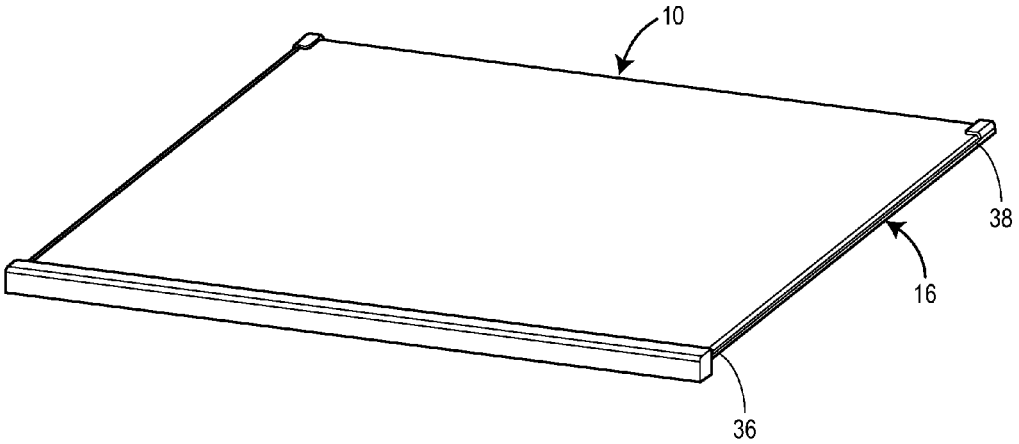
FIG. 17 is a front perspective view of still another alternative version of the shelving assembly of FIG. 1.
Figure 18:
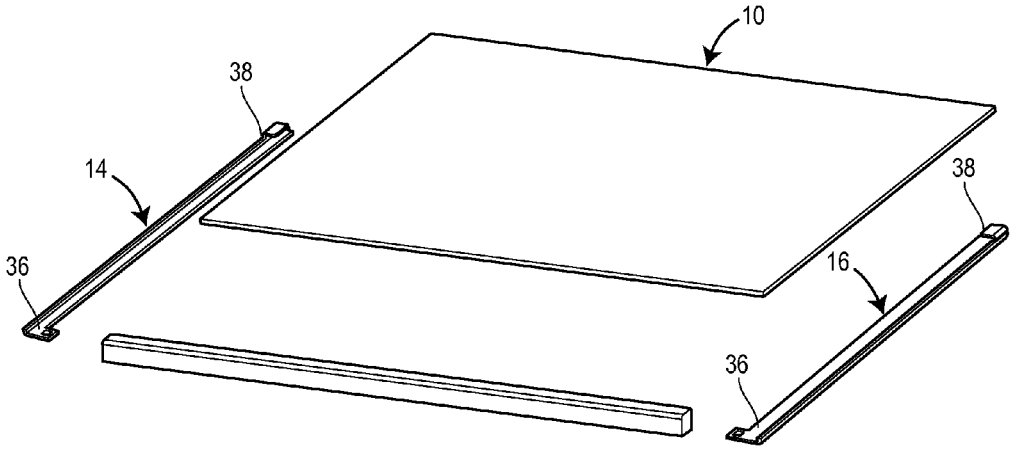
FIG. 18 is an exploded perspective view of the version of the shelving assembly of FIG. 17.
Figure 19:
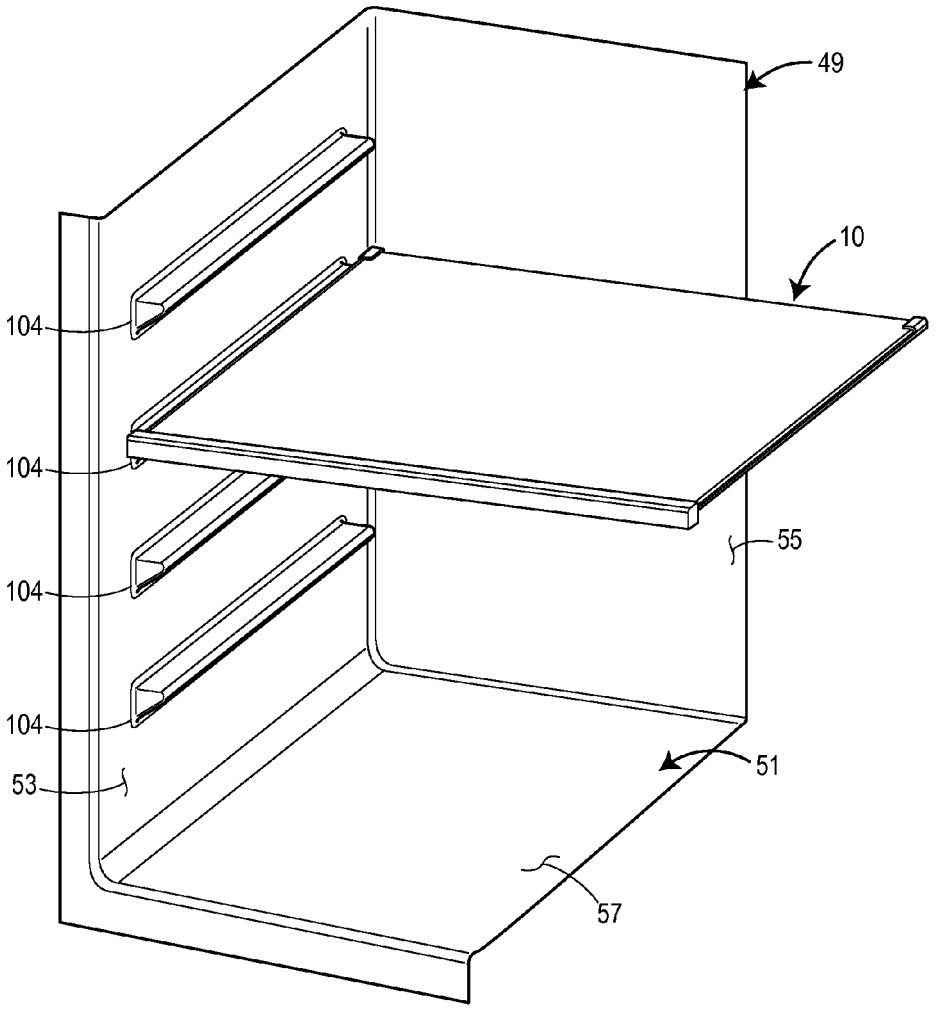
FIG. 19 is a partial perspective view of the shelving assembly of FIGS. 17 and 18 disposed within an appliance.

Further yet, while the various versions of the shelving assembly 10 described above with reference to FIGS. 1-16 are described as including support brackets 42 for connecting to the vertical support members 44 of the appliance 49 depicted in FIG. 9, for example, FIGS. 17-19 illustrate a still further alternative version of the shelving assembly 10. In FIGS. 17-19, the shelving assembly 10 is essentially identical to the versions described above but for the fact that it is adapted to be supported on support forms that include left and right horizontal support ribs 104 (only the left side are shown in FIG. 19) formed on left and right sidewalls 53 in the cavity 51 of the appliance 49, as shown in FIG. 19. Therefore, the shelving assembly 10 in FIGS. 17-19 does not include a wire frame 22, as described with reference to FIGS. 1-12, or support panels 100, as described with respect to FIGS. 12-16. Instead, bottom surfaces of the side supports 14, 16 rest directly on the ribs 104. Although not depicted in FIGS. 17-19, the shelving assembly 10 could include one or more connector components similar to the reinforcement rods 102 described above, for example, extending between the side supports 14, 16 at one or more location between the front and rear 36, 38 ends, for additional strength, if desired.

Accordingly, based on the foregoing, it can be seen that in each and every version of the shelving assembly 10 described herein the combination of the rear and front anti-tip and retention features 18, 20 effectively and simply serve to retain the support plate 12 connected to the side supports 14, 16, while advantageously preventing tipping when the support plate 12 is unevenly loaded, for example. Thus, it can be said that the front and rear anti-tip and retention features 18, 20, in combination, define an anti-tip and retention means for preventing tipping of the support plate 12 and for retaining the support plate 12 on the left and right side supports 14, 16 while also leaving a majority of the top surface 24 of the support plate 12 along the left and right side edges 28, 30 freely exposed and unencumbered.

Regardless of the materials mentioned herein for any one of the described components of the shelving assembly 10, it should be understood that generally any suitable material can be used and is intended to be within the scope or the present disclosure.

While various examples have been described, each potentially including distinct components, etc., it should be appreciated that different components of different examples are intended to be interchanged and combined such that the disclosure as a whole, would be understood by a person having ordinary skill in the art, to include any combination of any of the features described herein or depicted in the figures.

The foregoing description provides numerous examples of shelving assemblies, but the scope of the invention is not intended to be limited by the descriptive examples. Rather, the scope of the invention is to include all which is encompassed by the spirit and scope of the following claims.

What is claimed:

1. An anti-tip and retention assembly for a support plate of an appliance, the support plate including opposite top and bottom surfaces, opposite left and right side edges, and opposite front and rear edges extending between the left and right side edges, the anti-tip and retention assembly comprising:

left and right side supports adapted to be arranged adjacent to the bottom surface of the support plate at the left and right side edges, respectively, for supporting the support plate in the appliance, each of the left and right side supports including a front end adapted to be located adjacent to the front edge of the support plate, and a rear end adapted to be located adjacent to the rear edge of the support plate;

a rear anti-tip and retention feature connected to the rear end of at least one of the left and right side supports, at least a portion of the rear anti-tip and retention feature adapted to be disposed above the top surface of the support plate adjacent to the rear edge for preventing tipping support plate and for retaining the support plate on the left and right side supports; and a front anti-tip and retention feature connected to the front end of at least one of the left and right side supports, at least a portion of the front anti-tip and retention feature adapted to be disposed above and adjacent to the top surface of the support plate adjacent to the front edge for preventing tipping of the support plate and for retaining the support plate on the left and right side supports, wherein, when the front anti-tip and retention feature is connected to the front ends of the side supports, the front anti-tip and retention feature and the rear anti-tip and retention feature are spaced apart by a majority of a distance between the front and rear ends of the left and right side supports such that when the support plate is installed, a majority of the top surface of the support plate along the left and right side edges is freely exposed and unencumbered by the front anti-tip and retention feature and rear anti-tip and retention feature.

2. The assembly of claim 1, wherein the rear anti-tip and retention feature comprises separate left and right anti-tip and retention forms connected to the rear ends of the left and right side supports, respectively.

3. The assembly of claim 2, wherein each anti-tip and retention form includes a bearing plate adapted to be disposed above the top surface of the support plate for preventing the support plate from tipping off of the left and right side supports and to retain the support plate on the left and right side supports through engagement with the top surface.

4. The assembly of claim 2, wherein each anti-tip and retention form includes a stop plate adapted to be disposed beside and adjacent to the rear edge of the support plate and adapted to retain the support plate on the left and right side supports through engagement with the rear edge.

5. The assembly of claim 2, wherein the left and right anti-tip and retention forms are formed integral with the left and right side supports, respectively.

6. The assembly of claim 2, wherein the left and right anti-tip and retention forms are spaced apart such that when assembled with support plate, a majority of the top surface of the support plate along the rear edge is freely exposed and unencumbered by the left and right anti-tip and retention forms.

7. The assembly of claim 1, wherein the rear anti-tip and retention feature comprises a rear trim form that when assembled with the support plate, is adapted to extend along the rear edge of the support plate between the rear ends of the left and right side supports, the rear trim form adapted to be connected to the rear ends of the left and right side supports and to the rear edge of the support plate.

8. The assembly of claim 7, wherein the rear trim form includes a bearing portion adapted to be disposed above the top surface of the support plate and adapted to prevent the support plate from tipping off of the left and right side supports and to retain the support plate on the left and right side supports through engagement with the top surface.

9. The assembly of claim 8, wherein the rear trim form includes a stop portion adapted to be disposed beside and adjacent to the rear edge of the support plate and adapted to retain the support plate on the left and right side supports through engagement with the rear edge.

10. The assembly of claim 7, wherein the rear end of each of the left and right side supports includes a locking aperture and opposite left and right ends of the rear trim form each includes a locking button adapted to be disposed in the respective locking aperture for connecting the rear trim form to the rear ends of the left and right side supports.

11. The assembly of claim 1, wherein the front anti-tip and retention feature comprises a front trim form adapted to extend along the front edge of the support plate between the front ends of the left and right side supports, the front trim form adapted to be connected to the front ends of the left and right side supports and to the front edge of the support plate.

12. The assembly of claim 11, wherein the front trim form includes a bearing portion adapted to be disposed above the top surface of the support plate and adapted to prevent the support plate from tipping off of the left and right side supports and to retain the support plate on the left and right side supports through engagement with the top surface.

13. The assembly of claim 12, wherein the front trim form includes a stop portion adapted to be disposed beside and adjacent to the front edge of the support plate and adapted to retain the support plate on the left and right side supports through engagement with the front edge.

14. The assembly of claim 11, wherein the front end of each of the left and right side supports includes a locking aperture and opposite left and right ends of the front trim form each includes a locking button adapted to be disposed in the respective locking aperture for connecting the front trim form to the front ends of the left and right side supports.

15. The assembly of claim 1, further comprising a cantilever support bracket extending rearward from each of the rear ends of the left and right side supports for connecting to vertical support members of an appliance cavity.

16. The assembly of claim 1, wherein the top surface of the support plate includes a hydrophobic surface arranged in a spill containment pattern.

17. The assembly of claim 1, further comprising a light strip providing a lighting feature beneath the support plate.

18. An anti-tip and retention assembly for a support plate of an appliance, the support plate including opposite top and bottom surfaces, opposite left and right side edges, and opposite front and rear edges extending between the left and right side edges, the anti-tip and retention assembly comprising:

left and right side supports adapted to be arranged adjacent to the bottom surface of the support plate at the left and right side edges, respectively, for supporting the support plate in the appliance, each of the left and right side supports including a front end adapted to be located adjacent to the front edge of the support plate, and a rear end adapted to be located adjacent to the rear edge of the support plate;

a rear anti-tip and retention feature connected to the rear end of at least one of the left and right side supports, at least a portion of the rear anti-tip and retention feature disposed above the top surface of the support plate adjacent to the rear edge for preventing tipping of the support plate and for retaining the support plate on the left and right side supports;

wherein the rear anti-tip and retention feature is configured such that a majority of the top surface of the support plate along the left and right side edges is freely exposed and unencumbered.

19. The assembly of claim 18, further comprising a front anti-tip and retention feature connected to the front end of at least one of the left and right side supports, at least a portion of the front anti-tip and retention feature disposed above and adjacent to the top surface of the support plate adjacent to the front edge for preventing tipping of the support plate and for retaining the support plate on the left and right side supports, the front and rear anti-tip and retention features spaced apart such that the majority of the top surface of the support plate along the left and right side edges between the front and rear anti-tip and retention features is freely exposed and unencumbered.

20. The assembly of claim 18, wherein the rear anti-tip and retention feature comprises separate left and right anti-tip and retention forms connected to the rear ends of the left and right side supports, respectively.

21. The assembly of claim 20, wherein each anti-tip and retention form includes a bearing plate adapted to be disposed above the top surface of the support plate for preventing the support plate from tipping off of the left and right side supports and to retain the support plate on the left and right side supports through engagement with the top surface.

22. The assembly of claim 20, wherein each anti-tip and retention form includes a stop plate adapted to be disposed beside and adjacent to the rear edge of the support plate and adapted to retain the support plate on the left and right side supports through engagement with the rear edge.

23. The assembly of claim 20, wherein the left and right anti-tip and retention forms are formed integral with the left and right side supports, respectively.

24. The assembly of claim 20, wherein the left and right anti-tip and retention forms are spaced apart such that when assembled with support plate, a majority of the top surface of the support plate along the rear edge is freely exposed and unencumbered by the left and right anti-tip and retention forms.

25. The assembly of claim 18, wherein the rear anti-tip and retention feature comprises a rear trim form that when assembled with the support plate, is adapted to extend along the rear edge of the support plate between the rear ends of the left and right side supports, the rear trim form adapted to be connected to the rear ends of the left and right side supports and to the rear edge of the support plate.

26. The assembly of claim 24, wherein the rear trim form includes a bearing portion adapted to be disposed above the top surface of the support plate and adapted to prevent the support plate from tipping off of the left and right side supports and to retain the support plate on the left and right side supports through engagement with the top surface.

27. The assembly of claim 25, wherein the rear trim form includes a stop portion adapted to be disposed beside and adjacent to the rear edge of the support plate and adapted to retain the support plate on the left and right side supports through engagement with the rear edge.

28. The assembly of claim 24, wherein the rear end of each of the left and right side supports includes a locking aperture and opposite left and right ends of the rear trim form each includes a locking button adapted to be disposed in the respective locking aperture for connecting the rear trim form to the rear ends of the left and right side supports.

29. The assembly of claim 19, wherein the front anti-tip and retention feature comprises a front trim form adapted to extend along the front edge of the support plate between the front ends of the left and right side supports, the front trim form adapted to be connected to the front ends of the left and right side supports and to the front edge of the support plate.

30. The assembly of claim 28, wherein the front trim form includes a bearing portion adapted to be disposed above the top surface of the support plate and adapted to prevent the support plate from tipping off of the left and right side supports and to retain the support plate on the left and right side supports through engagement with the top surface.

31. The assembly of claim 29, wherein the front trim form includes a stop portion adapted to be disposed beside and adjacent to the front edge of the support plate and adapted to retain the support plate on the left and right side supports through engagement with the front edge.

32. The assembly of claim 28, wherein the front end of each of the left and right side supports includes a locking aperture and opposite left and right ends of the front trim form each includes a locking button adapted to be disposed in the respective locking aperture for connecting the front trim form to the front ends of the left and right side supports.

33. The assembly of claim 18, further comprising a cantilever support bracket extending rearward from each of the rear ends of the left and right side supports for connecting to vertical support members of an appliance cavity.

34. The assembly of claim 18, wherein the top surface of the support plate includes a hydrophobic surface arranged in a spill containment pattern.

35. The assembly of claim 18, further comprising a light strip providing a lighting feature beneath the support plate.

* * * * *